US005537925A

United States Patent [19]

Secor et al.

[11] Patent Number: 5,537,925

[45] Date of Patent: Jul. 23, 1996

[54] INFRA-RED FORCED AIR DRYER AND EXTRACTOR

[75] Inventors: Howard C. Secor, Coppell; Ronald M. Rendleman, Dallas; Paul D. Copenhaver, Colleyville, all of Tex.

[73] Assignee: Howard W. DeMoore, Dallas, Tex.

[21] Appl. No.: 116,711

[22] Filed: Sep. 3, 1993

[51] Int. Cl.[6] ..... B41F 35/00

[52] U.S. Cl. ..... 101/424.1; 101/488; 34/273; 34/274; 34/420; 34/421

[58] Field of Search ..... 34/418, 419, 267, 34/273, 274, 420, 421; 101/424.1, 424.2, 487, 488; 219/388, 216

[56] References Cited

U.S. PATENT DOCUMENTS

| | | | |
|---|---|---|---|
| 3,900,959 | 8/1975 | Breschi et al. | 34/155 |
| 4,257,172 | 3/1981 | Townsend | 34/68 |
| 4,434,562 | 3/1984 | Bubley et al. | 34/4 |
| 4,449,453 | 5/1984 | Staffer et al. | 101/416 |
| 4,501,072 | 2/1985 | Jacobi, Jr. | 34/1 |
| 4,513,516 | 4/1985 | Björnberg | 34/41 |
| 4,545,131 | 10/1985 | Ericsson | 34/4 |
| 4,594,266 | 6/1986 | Lemaire et al. | 34/273 |
| 4,596,935 | 6/1986 | Lumpp | 250/495.1 |
| 4,693,013 | 9/1987 | Pabst et al. | 34/4 |
| 4,698,767 | 10/1987 | Wensel et al. | 364/471 |
| 4,716,658 | 1/1988 | Jacobi, Jr. | 34/4 |
| 4,727,655 | 3/1988 | Jacobi, Jr. | 34/4 |
| 4,773,167 | 9/1988 | Jacobi, Jr. | 34/4 |
| 4,783,908 | 11/1988 | Pabst | 34/273 |
| 4,798,007 | 1/1989 | Eichenlaub | 34/4 |
| 4,809,608 | 3/1989 | Wolnick et al. | 101/416.1 |
| 4,811,493 | 3/1989 | Burgio, Jr. | 34/4 |
| 4,876,437 | 10/1989 | Kondo | 219/388 |
| 4,882,852 | 11/1989 | Kautto | 34/273 |
| 4,882,992 | 11/1989 | Schmoeger | 101/424.1 |
| 4,989,343 | 2/1991 | Ericsson | 34/420 |
| 5,010,659 | 4/1991 | Treleven | 34/41 |
| 5,060,572 | 10/1991 | Waizmann | 101/424.1 |
| 5,092,059 | 3/1992 | Winberger et al. | 34/156 |
| 5,099,586 | 3/1992 | Anderson | 34/68 |
| 5,142,795 | 9/1992 | Abbott | 34/41 |
| 5,263,265 | 11/1993 | Melgaard | 34/421 |
| 5,296,680 | 3/1994 | Yamada | 219/388 |
| 5,317,127 | 5/1994 | Brewster et al. | 34/273 |

*Primary Examiner*—Edgar S. Burr
*Assistant Examiner*—Anthony H. Nguyen
*Attorney, Agent, or Firm*—Dennis T. Griggs

[57] ABSTRACT

An infra-red dryer utilizes high velocity air jets which scrub and break up the moist air layer which clings to the surface of a freshly printed and/or coated sheet. The high velocity air jets are directed through multiple air flow apertures across an array of infra-red lamps onto the freshly printed and/or coated sheets. An extractor exhausts the moisture-laden air from an exposure zone while short wave infra-red radiation heats the ink and/or protective coating. The effective exposure to pressurized air is increased by the air jets which produce a balanced pressure air blanket along the sheet travel path. The moist air layer is displaced from the printed and/or coated sheet and is extracted from the press as the sheet moves through the exposure zone.

15 Claims, 5 Drawing Sheets

INFRA-RED FORCED AIR DRYER AND EXTRACTOR

FIELD OF THE INVENTION

This invention is related generally to accessories for sheet-fed, rotary offset printing presses, and in particular to a dryer for printed materials which utilizes infra-red radiant heat, forced air flow and extraction.

BACKGROUND OF THE INVENTION

In the operation of a rotary offset press, an image is reproduced on a sheet of paper or some other print stock by a plate cylinder which carries the image, a blanket cylinder which has an ink transfer surface for receiving the inked image, and an impression cylinder which presses the paper against the blanket cylinder so that the inked image is transferred to the paper. In some applications, a protective and/or decorative coating is applied to the surface of the freshly printed sheets.

The freshly printed sheets are then conveyed to a sheet delivery stacker in which the finally printed sheets are collected and stacked.

The wet ink and coatings should be dried before the sheets are stacked or run back through the press for a second pass, to prevent smearing defects and to prevent offsetting of the ink on the unprinted side of the sheets as they are stacked. Spray powder has been applied between the freshly printed sheets which are to be stacked to improve sheet handling and to separate one delivered sheet from the next sheet to prevent offsetting while the ink and/or coating dries. One limitation on the use of spray powder is that fugitive particles of the spray powder disperse into the press room and collect on press equipment, causing electrical and mechanical breakdowns and imposing a potential health hazard for press room personnel.

DESCRIPTION OF THE PRIOR ART

Hot air convection heaters and radiant heaters have been employed to reduce the volume of spray powder applied, except for the small amount needed for sheet handling purposes. Hot air convection heaters are best suited for slow to moderate speed press runs in which the exposure time of each printed sheet to the hot air convection flow is long enough that aqueous base inks and coatings are set before the sheets reach the stacker.

For high-speed press operation, for example, at 5,000 sheets per hour or more, the exposure time of each printed sheet as it passes through the dryer station is not sufficient to obtain good drying by convection flow alone. Radiant heaters such as infra-red heat lamps provide greater drying efficiency because the short wave length infra-red energy is preferentially absorbed in the liquid inks and coatings to provide rapid evaporation. The infra-red radiant energy releases water and volatiles from the ink and/or coating. Consequently, a humid air layer clings to the printed surface of the sheet as it moves through the dryer, and will be trapped between adjacent sheets in the stack unless it is removed.

As press speed is increased, the exposure time (the length of time that printed sheet is exposed to the radiant heat) is reduced. Consequently, the output power of the radiant lamp dryers has been increased to deliver more radiant energy to the printed sheets in an effort to compensate for the reduction in exposure time.

The higher operating temperatures of the high-powered lamps cause significant heat transfer to the associated printing unit, coater and press frame equipment, accelerated wear of bearings and alterations in the viscosities of the ink and coating, as well as upsetting the water balance of aqueous coatings. The heat build-up may also cause operator discomfort and injury.

OBJECT OF THE INVENTION

The principal object of the present invention is to increase the operating efficiency of a printing press dryer of the type which utilizes radiant lamps to dry inks and coatings on freshly printed and/or coated sheets.

A related object of the present invention is to provide a high efficiency, high power output radiant heater which includes improved means for limiting the transfer of heat to nearby parts and press equipment.

Another object of the present invention is to increase the effective exposure time of a freshly printed sheet to forced air flow in a printing press dryer so that the printing press may be operated at higher speeds without compromising quality.

Yet another object of the present invention is to provide an improved radiant heat dryer of the character described which includes means for removing the humid air layer from the surface of a freshly printed sheet and extracting it from the press, thereby accelerating the drying process.

SUMMARY OF THE INVENTION

The foregoing objects are achieved according to the present invention by a combination forced air and radiant heat dryer in which the exposure to forced air flow is increased by broadening the air base. Forced air at high pressure is discharged uniformly through precision holes located directly above an array of infra-red lamps onto a freshly printed and/or coated sheet as it moves along a sheet transport path to a delivery stack.

According to one aspect of the present invention, the moist air layer is displaced from the surface of the printed sheet by high-velocity air jets which scrub and break-up the moisture-laden air layer that adheres to the printed surface of the sheet. The high-velocity air jets create turbulence which overcomes the surface tension of the moisture and separates the moisture laden air from the surface of the paper. The moisture laden air becomes entrained in the forced air flow and is removed from the press as the moisture laden air is extracted.

Effective exposure to the forced air flow is increased by multiple air jets, in which the air jets are arranged to deliver a substantially uniform blanket of the high velocity air across the sheet transport path. Preferably, the high velocity air jets are uniformly spaced with respect to each other along the sheet delivery path. Since the release of moisture and other volatiles from the ink and/or coating occurs continuously during exposure in response to the absorption of infra-red radiation, the moisture laden air layer is displaced continuously from the printed sheet as the printed sheet travels through the dryer and crosses the multiple air jets.

After a printed sheet exits the dryer, and before the arrival of the next successive printed sheet, residual moisture-laden air is completely exhausted from the press by an extractor. According to this arrangement, the drying of each printed sheet is accelerated before it is placed on the delivery stack. If a protective coating is applied over the ink, the coating is completely dried and a dry film is established over the wet ink. This permits the ink to thoroughly cure under the coating after stacking, thus eliminating the need for spray powder to control offsetting.

Operational features and advantages of the present invention will be understood by those skilled in the art upon reading the detailed description which follows with reference to the attached drawings.

DETAILED DESCRIPTION OF THE PREFERRED EMBODIMENT

As used herein, the term "processed" refers to various printing processes which may be applied to either side of a sheet or web, including the application of inks and/or coatings. The term "substrate" refers to sheets or web stock.

Figure 1:
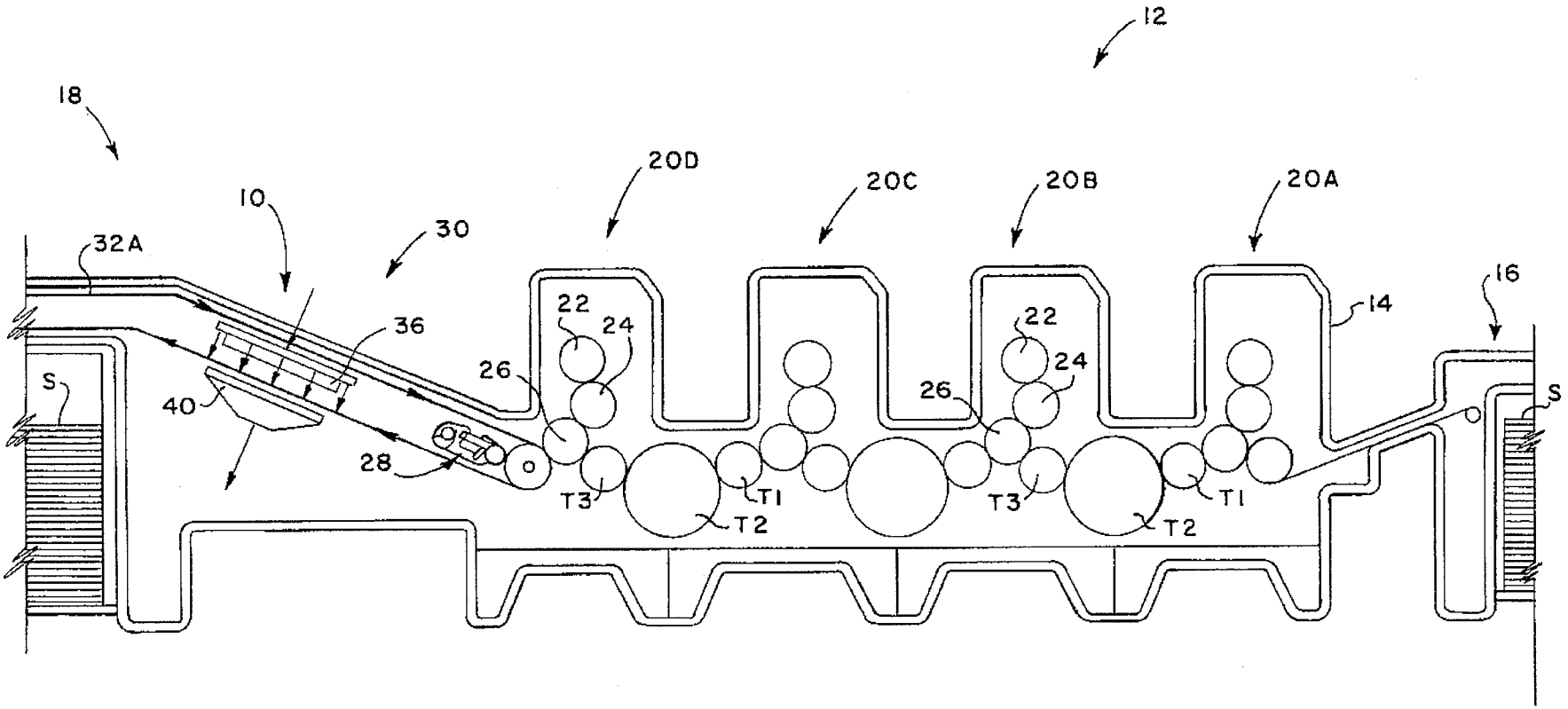
FIG. 1 is a schematic side elevational view in which the dryer of the present invention is installed in a four color offset rotary printing press.
Figure 2:
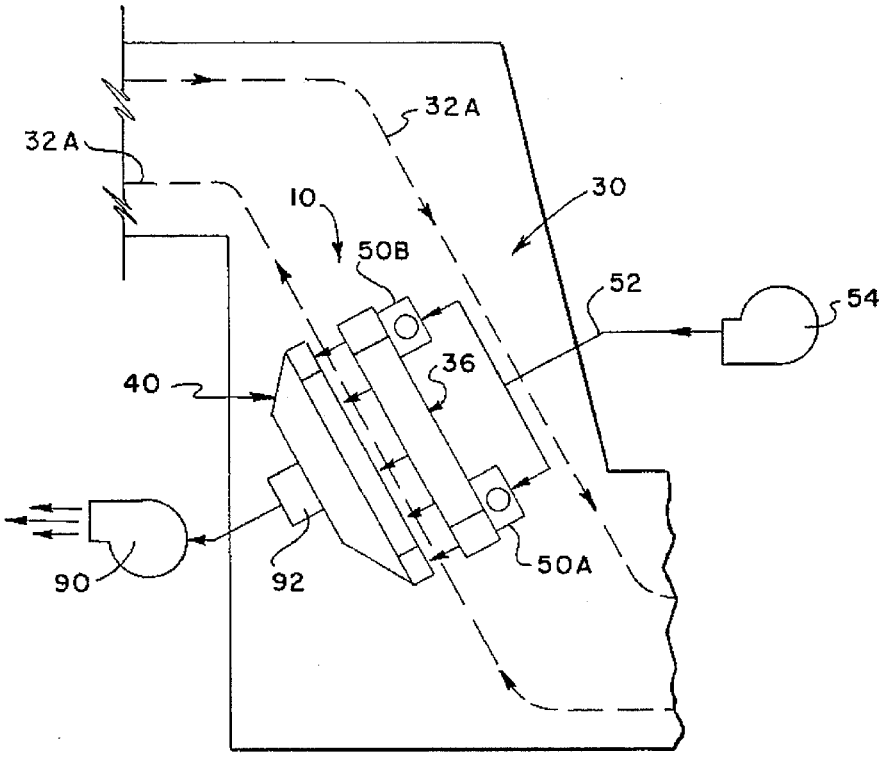
FIG. 2 is a simplified side elevational view showing the installation of the dryer of the present invention in the delivery conveyor section of FIG. 1.

Referring now to FIG. 1, the dryer 10 of the present invention will be described as used for drying freshly printed substrates, either sheets or web stock, which have a protective and/or decorative coating which has been applied in a sheet-fed or web-fed, rotary offset or flexographic printing press. In this instance, the dryer 10 of the present invention is mounted on the guide rails of the delivery conveyor of a four color printing press 12 which is capable of handling individual printed sheets having a width of the approximately 40' (102 millimeters) and capable of printing 10,000 sheets per hour or more, such as that manufactured by Heidelberg Druckmaschinen AG of Germany under its designation Heidelberg Speedmaster 102 V.

The press 12 includes a press frame 14 coupled on the right end to a sheet feeder 16 from which sheets, herein designated S, are individually and sequentially fed into the press, and at the opposite end, with a sheet delivery stacker 18 in which the finally printed sheets are collected and stacked. Interposed between the sheet feeder and the sheet delivery stacker 18 are four substantially identical sheet printing units 20A, 20B, 20C and 20D which can print different color inks onto the sheets as they are moved through the press.

As illustrated in FIG. 1, each sheet fed printing unit is of conventional design, each unit including a plate cylinder 22, a blanket cylinder 24 and an impression cylinder 26. Freshly printed sheets from the impression cylinder 26 are transferred to the next printing unit by transfer cylinders T1, T2, T3. A protective coating is applied to the printed sheets by a coating unit 28 which is positioned adjacent to the last printing unit 20. The coating unit 28 is preferably constructed as disclosed in my U.S. Pat. No. 5,176,077, which is incorporated herein by reference.

Figure 3:
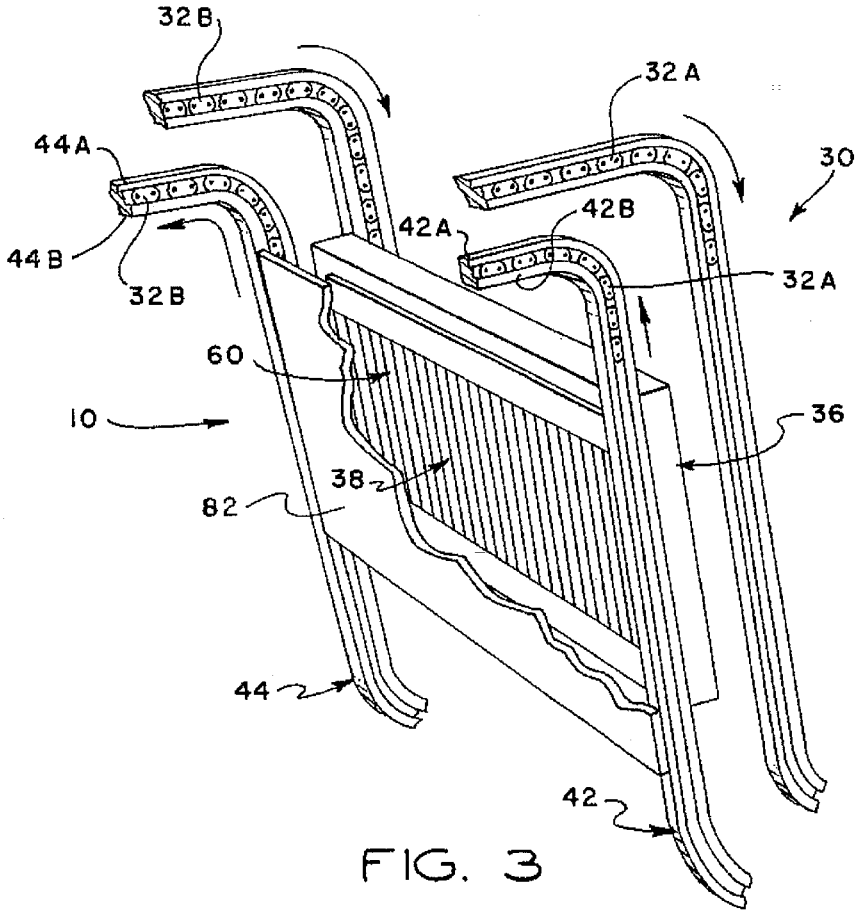
FIG. 3 is a perspective view, partially broken away, showing installation of the dryer assembly of FIG. 2 on the gripper chain guide rails.
Figure 5:
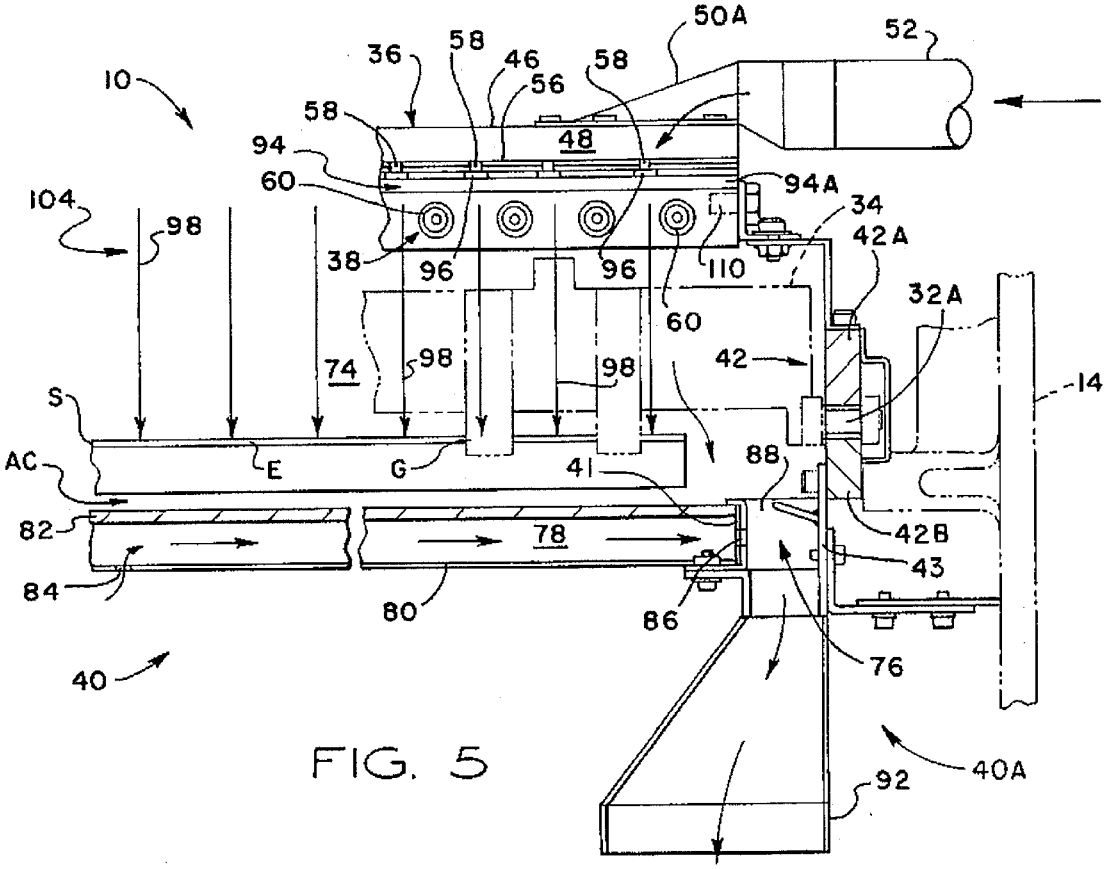
FIG. 5 is a sectional view of the improved dryer of the present invention taken along the line 5—5 of FIG. 4.

The freshly printed and coated sheets S are transported to the delivery stacker 18 by a delivery conveyor system, generally designated 30. Referring now to FIG. 1, FIG. 3 and FIG. 5, the delivery conveyor 30 is of conventional design and includes a pair of endless delivery gripper chains 32A, 32B shown carrying laterally disposed gripper bars 34 (FIG. 5) having a gripper element G for gripping the leading edge E of a freshly printed sheet S as it leaves the impression cylinder 26. As the leading edge E of the printed sheet S is gripped by the gripper G, the delivery chains 32A, 32B pull the gripper bar 34 and sheet S away from the impression cylinder and transports the freshly printed and coated sheet to the sheet delivery stacker 18.

Figure 4:
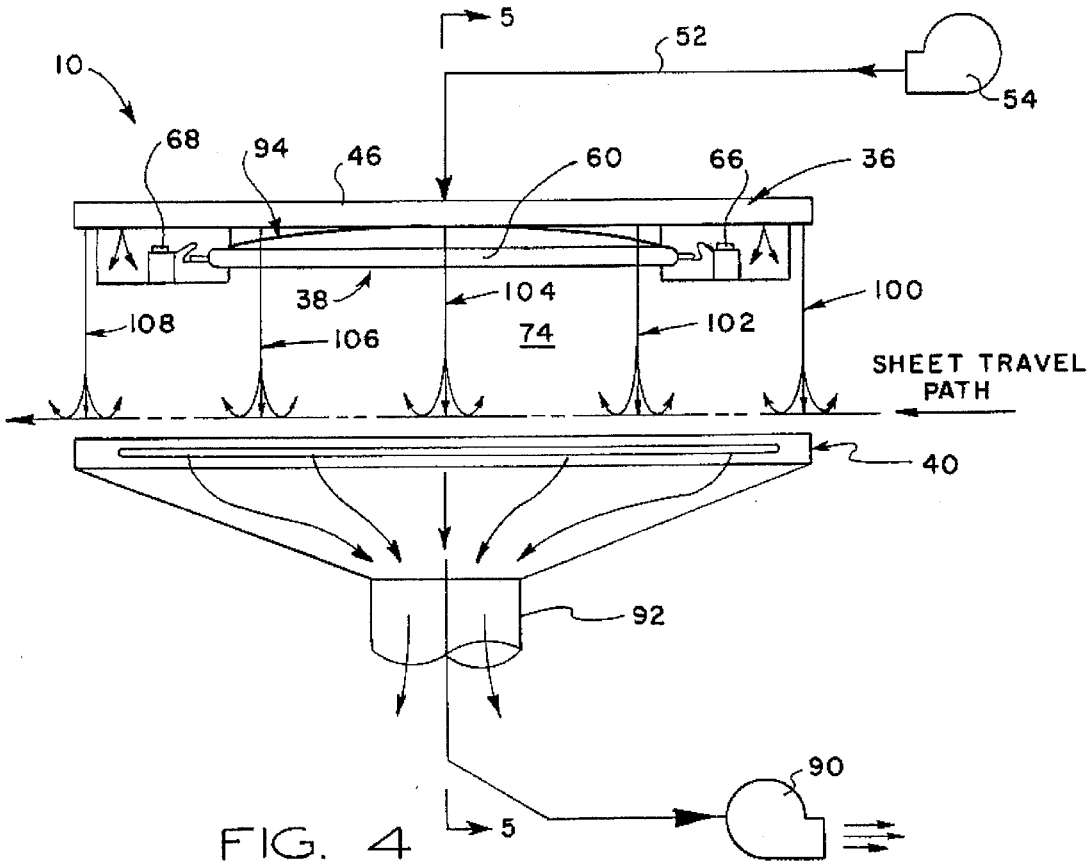
FIG. 4 is a simplified schematic diagram showing the principal dryer components of the present invention.

Prior to delivery to the sheet delivery stacker 18, the freshly printed sheets are dried by a combination of infra-red thermal radiation, forced air flow and extraction. Referring now to FIG. 2, FIG. 3, FIG. 4 and FIG. 5, the dryer 10 includes as its principal components a dryer head 36, a radiant heat lamp assembly 38, and an extractor head 40. As shown in FIG. 3 and FIG. 5, the dryer head 36 is mounted on the upper section 42A of a chain guide rail 42, and likewise on the upper chain guide section 44A of a chain guide rail 44. In this position, the dryer head 36 is extended across and spaced from the sheet travel path P (FIG. 4).

Figure 7:
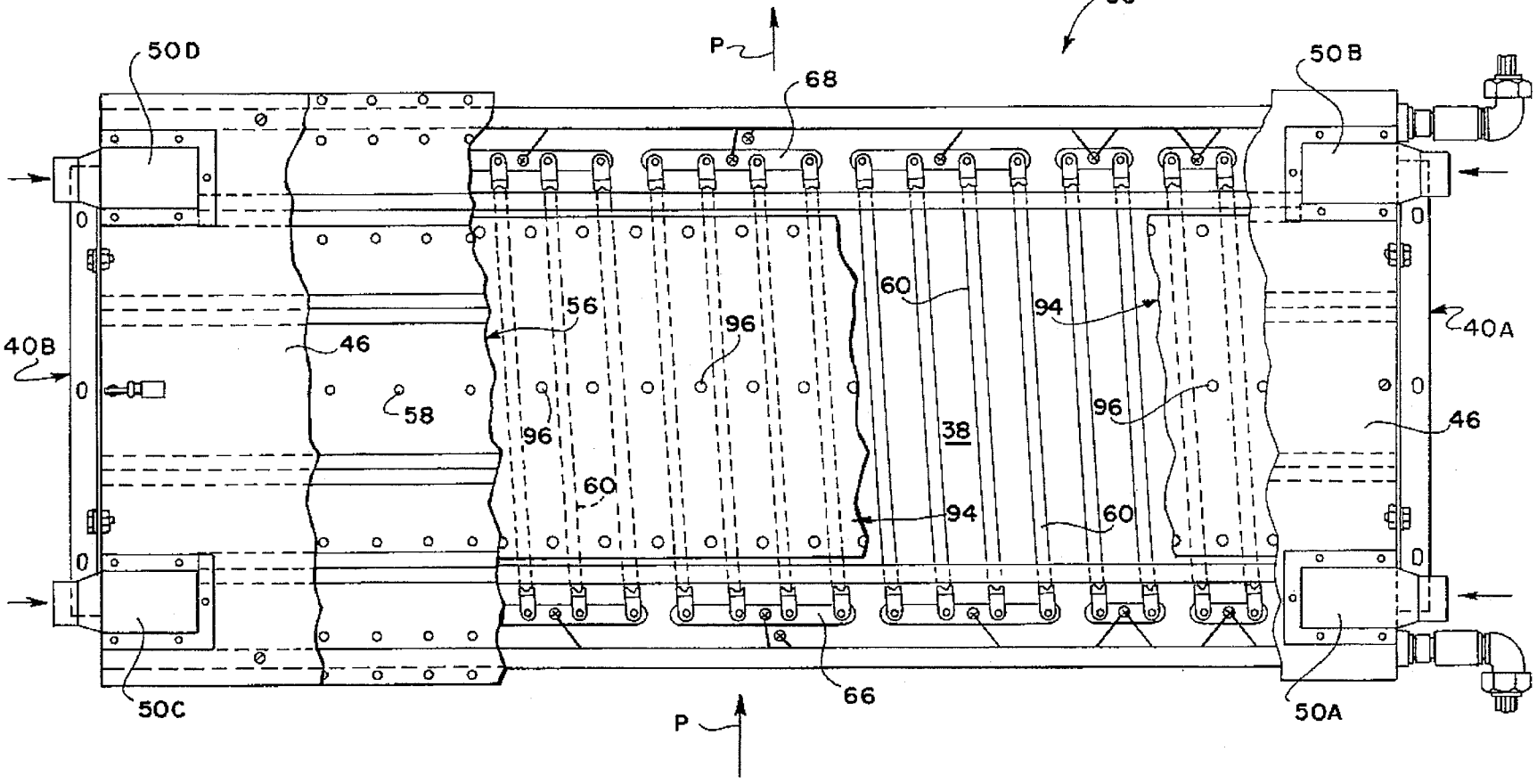

The dryer head includes a housing 46 defining an air distribution manifold chamber 48. The air distribution manifold housing includes multiple inlet ports 50A, 50B, 50C and 50D for receiving pressurized air through a supply duct 52 from a blower fan 54. As shown in FIG. 7, the air distribution manifold housing 46 includes a distribution panel 56 which is intersected by multiple discharge ports 58 which are oriented for discharging pressurized jets of air toward the sheet travel path. The discharge ports 58 are uniformly spaced so that a uniform blanket of pressurized air is produced across the processed side of a sheet S as it moves through the dryer.

Figure 6:
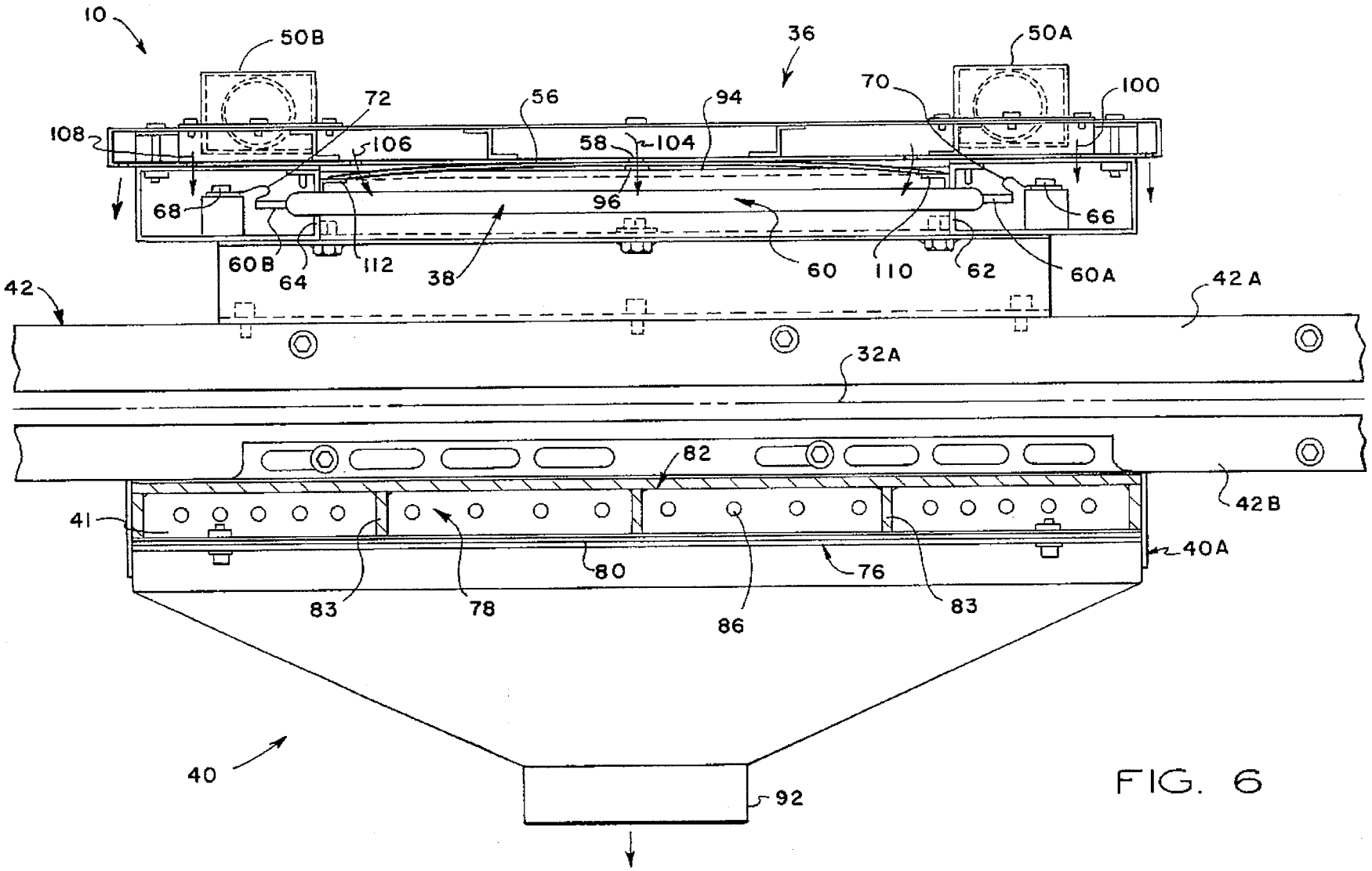
FIG. 6 is an elevational view, partially in section, of the dryer assembly shown in FIG. 2; and, FIG. 7 is a top plan view, partially in section, of the dryer assembly shown in FIG. 2.

Referring now to FIG. 6 and FIG. 7, the heat lamp assembly 38 includes an array of heat lamps 60 extending transversely with respect to the sheet travel path P substantially in parallel relation with each other. The radiant heat lamps 60 are supported between the sheet travel path P and the air distribution manifold by end brackets 62, 64. The ends of each heat lamp project through circular apertures formed in the end brackets. Each heat lamp 60 includes electrodes 60A, 60B which are electrically connected to power buses 66, 68 by flexible, conductive straps 70, 72, respectively. According to this arrangement, each heat lamp 60 is free to expand and contract longitudinally in response to thermal cycling.

Each heat lamp 60 is preferably an infra-red radiant lamp having an output in the short wavelength (near) infra-red region (from about 0.70 to about 1.50 micrometers). The power dissipation of each infra-red lamp may be selected from the range of 500 watts–2 kw. In the exemplary embodiment, each lamp is a short wavelength infra-red quartz lamp having an electrical power rating of 1 kw.

Referring now to FIG. 2, FIG. 4, FIG. 5 and FIG. 6, the extractor head 40 is mechanically attached to the lower guide rail section 42B of the chain guide rail 42, and likewise is connected to the lower chain guide rail 44B on the opposite side. The extractor head 40 is positioned facing the back side of a freshly processed sheet as it moves along the sheet travel path. According to this arrangement, an exposure zone 74 is bounded between the dryer head 36 and the extractor head 40, and is substantially co-extensive with the length and width of the radiant heat lamp assembly 38.

Referring again to FIG. 5, the extractor head 40 includes housing panels 41, 43 defining an air extractor manifold chamber 76 on laterally opposite sides of the exposure zone. Each manifold chamber 76 has an inlet port 88 coupled in air flow communication with the exposure zone 74. The extractor head 40 also includes an air circulation passage 78 which is enclosed between a lower manifold panel 80 and a support plate 82. The support plate 82 defines the lower boundary of the exposure zone 74, and limits downward deflection of the trailing end of the sheet S. The support plate 82 is reinforced by multiple ribs 83 which extend between the support plate and the manifold panel 80.

The support plate 82 and the ribs 83 serve as a heat sink for conducting thermal energy out of the exposure zone 74, in response to heat exchange with cooling air flowing through the air circulation passage 78. The air circulation passage 78 has an inlet port 84 connecting the air circulation passage in flow communication with a source of cooling air (for example ambient air), and a vent port 86 connecting the air circulation passage 78 in air flow communication with the extractor manifold chamber 76.

As shown in FIG. 4 and FIG. 5, the extractor manifold inlet port 88 is coupled in air flow communication with the exposure zone 74 for extracting heat and moisture laden air out of the dryer. The extractor manifold chamber 76 is coupled in air flow communication with an exhaust blower fan 90 by an air duct 92. The air flow capacity of the exhaust blower fan 90 is preferably about four times the flow capacity provided by the forced air blower fan 54. This will ensure that the exposure zone 74 is maintained at a pressure level less than atmospheric, thereby preventing the escape of hot, moisture laden air into the press room.

Referring now to FIG. 4, FIG. 5, and FIG. 7, a reflector plate 94 is mounted intermediate the air distribution panel 56 and the heat lamp assembly 38. The reflector plate is intersected by multiple air flow apertures 96 which are disposed in air flow communication with the discharge ports 58 which are formed in the distribution panel 56. The air flow apertures 96 are oriented to direct jets 98 of pressurized air through the heat lamp assembly and onto a printed and/or coated (processed) sheet S moving along the sheet travel path.

According to one aspect of the present invention, the multiple air flow apertures are arranged in linear rows 100, 102, 104, 106 and 108 which extend transversely with respect to the direction of sheet travel. The rows are longitudinally spaced with respect to each other along the sheet travel path. Each air jet expands in a conical pattern as it emerges from the air flow aperture 96. Expanding air jets from adjacent rows overlap along the sheet travel path, thereby producing a turbulent air blanket which scrubs the processed side of the sheet S as it moves through the exposure zone. Preferably, balanced air pressure is applied uniformly across the sheet S to ensure that the moist air layer is completely extracted.

Referring again to FIG. 5 and FIG. 7, the air distribution manifold discharge ports are arranged in similar linear rows which are spaced with respect to each other and are aligned with the rows in the reflector plate. In this arrangement, the discharge ports 58 in each row of the distribution manifold are aligned in flow registration with the air flow apertures 96 in each row of the reflector plate, respectively. Preferably, the air flow apertures 96 in the reflector plate are substantially centered with respect to adjacent heat lamps 60 whereby each pressurized air jet 98 is directed through one of the longitudinal spaces between adjacent lamps (see FIG. 5).

As shown in FIG. 5, the sheet support plate 82 faces the radiant heat lamps across the exposure zone 74 and is disposed substantially in alignment with the sheet travel path P for engaging the back side of a freshly processed sheet S as it is travels through the exposure zone. The leading edge E of the sheet S is gripped by the gripper means G, and the depending body portion of the sheet S rides on a thin air cushion AC along the support plate 82.

Referring again to FIG. 4 and FIG. 6, the reflector plate 94 is pre-stressed to assume the form of a convex arch under ambient temperature conditions, and approaches a flat plate configuration under production operating temperature conditions. According to this arrangement, the reflector plate 94 is prevented from touching the infra-red lamps 60 during production. The reflector plate 94 has side edge portions 94A, 94B which are mounted on first and second shoulder brackets 110, 112, respectively, on opposite sides of the dryer head. The shoulder brackets limit thermally induced deflection movement of the reflector plate 94 toward the heat lamps, while accommodating thermally induced lateral expansion and contraction movement of the reflector side edge portions 94A, 94B, respectively.

Although the present invention and its advantages have been described in detail, it should be understood that various changes, substitutions and alterations can be made herein without departing from the spirit and scope of the invention as defined by the appended claims.

What is claimed is:

1. A dryer for use in combination with a printing press of the type having conveyor apparatus for transporting a freshly processed substrate along a travel path comprising, in combination:

a dryer head adapted for installation in a position adjacent the travel path and facing a freshly processed substrate as it moves along the travel path, the dryer head including a housing defining an air distribution manifold, the air distribution manifold having an inlet port for receiving pressurized air and having discharge port means;

a heat lamp assembly disposed on the dryer head, the heat lamp assembly including multiple heat lamps supported between the travel path and the air distribution manifold;

a reflector plate disposed intermediate the air distribution manifold housing and the heat lamp assembly, the reflector plate being intersected by multiple air flow apertures disposed in air flow communication with the discharge port means of the air distribution manifold, and the air flow apertures being oriented to direct jets of pressurized air onto a freshly processed substrate moving along the travel path;

an extractor head disposed in a position adjacent the travel path and spaced from the dryer head, thereby defining an exposure zone therebetween, the extractor head including a housing defining an air extractor manifold having inlet port means coupled in airflow communication with the exposure zone for extracting air from the exposure zone and having a discharge port for exhausting the extracted air from the press;

a support plate spaced from the heat lamp assembly across from the exposure zone and disposed adjacent the substrate travel path for supporting a freshly processed substrate as it is transported through the exposure zone; and, a cooling air circulation manifold having a housing panel spaced from the support plate and defining an air circulation passage therebetween, the air circulation manifold having an inlet port for connecting the air circulation passage in communication with a source of cooling air, and having a vent port connecting the air circulation passage in air flow communication with the extractor manifold discharge port.

2. A dryer as defined in claim 1, wherein the multiple air flow apertures are arranged in linear rows extending transversely to the direction of substrate travel, the rows being longitudinally spaced with respect to each other along the travel path, with pressurized jets of air flowing through the air flow apertures in each row in combination producing an air blanket along a portion of the substrate travel path.

3. A dryer as defined in claim 2, wherein the air distribution manifold discharge port means comprise multiple discharge ports oriented for directing pressurized jets of air toward the travel path, the discharge ports being arranged in linear rows which are longitudinally spaced with respect to each other and aligned with the rows in the reflector plate, and the discharge ports of the distribution manifold being aligned in flow registration with the air flow apertures of the reflector plate, respectively.

4. A dryer as defined in claim 1, wherein each air flow aperture in the reflector plate is substantially centered with respect to a pair of adjacent heat lamps whereby each pressurized jet of air is directed through a longitudinal space between an adjacent pair of heat lamps.

5. A dryer as defined in claim 1, said extractor head comprising:

a first extractor manifold having an inlet port coupled in air flow communication with the exposure zone along one side of the travel path; and, a second extractor manifold having an inlet port coupled in air flow communication with the exposure zone along the laterally opposite side of the travel path.

6. A dryer as defined in claim 1, wherein the reflector plate is pre-stressed to assume the form of a convex arch under ambient temperature conditions.

7. A dryer as defined in claim 6, including:

first and second shoulders attached to opposite sides of the dryer head, the reflector plate having first and second side edge portions engaging the first and second shoulders, respectively, said shoulders limiting thermally induced deflection movement of the first and second portions toward the heat lamp assembly while accommodating thermally induced expansion movement of the reflector plate side edge portions, respectively.

8. A dryer for use in combination with a printing press of the type having conveyor apparatus for transporting a processed substrate along a travel path comprising, in combination:

a dryer head adapted for installation in a position facing the freshly processed side of a substrate as it moves along the travel path, the dryer head having a housing defining an air distribution manifold, the air distribution manifold including an inlet port for receiving pressurized air and having discharge port means for directing pressurized air jets toward the travel path;

a radiant heat lamp assembly disposed within the dryer head, the heat lamp assembly including multiple radiant heat lamps supported between the travel path and the air distribution manifold; and, an extractor head adapted for installation in a position facing the back side of a freshly processed substrate as it moves along the substrate travel path, thereby defining an exposure zone therebetween, the extractor head including a first extractor manifold having an inlet port coupled in air flow communication with the exposure zone along one side of the travel path, a second extractor manifold having an inlet port coupled in air flow communication with the exposure zone along the laterally opposite side of the travel path, and extractor port means coupled to the first and second extractor manifolds for extracting moisture laden air.

9. A dryer as defined in claim 8, the extractor head including:

a support plate extending across the exposure zone between the first and second extractor manifolds.

10. A dryer as defined in claim 9, including a cooling air circulation manifold having a housing panel spaced from the support plate and defining an air circulation passage therebetween, the air circulation manifold having an inlet port connecting the air circulation passage in communication with a source of cooling air, and having a discharge port connecting the circulation passage in air flow communication with the extractor manifold discharge port means.

11. A dryer as defined in claim 8, including:

a reflector plate disposed intermediate the air distribution manifold and the heat lamp assembly, the reflector plate being intersected by multiple air flow apertures disposed in air flow communication with the discharge ports of the air distribution manifold, and said air flow apertures being oriented to direct pressurized jets of air onto a freshly processed substrate moving along the travel path.

12. A dryer as defined in claim 11, wherein the multiple air flow apertures are arranged in linear rows extending transversely to the direction of sheet travel, the rows being longitudinally spaced with respect to each other along the travel path, wherein pressurized air jets flowing through the air flow apertures overlap across the travel path, thereby defining an air blanket.

13. A dryer as defined in claim 12, wherein the discharge port means comprises multiple discharge ports in the air distribution manifold arranged in linear rows which are longitudinally spaced with respect to each other and aligned with the rows in the reflector plate, and the discharge ports of each row of the distribution manifold being aligned in flow registration with the air flow apertures in the reflector plate.

14. A dryer as defined in claim 11, wherein one or more air flow apertures in the reflector plate are centered with respect to a pair of adjacent heat lamps so that one or more pressurized air jets are directed through the longitudinal spacing between an adjacent pair of heat lamps.

15. A dryer for use in combination with a printing press of the type having conveyor apparatus for transporting a processed substrate along a travel path comprising, in combination:

a dryer head adapted for installation in a position facing a freshly processed substrate as it moves along the travel path thereby defining an exposure zone between the dryer head and the travel path, the dryer head having a housing defining an air distribution manifold, the air distribution manifold including an inlet port for receiving pressurized air and having discharge port means for directing the pressurized air toward the travel path;

a heat lamp assembly disposed within the dryer head, the heat lamp assembly including multiple radiant heat lamps supported between the travel path and the air distribution manifold;

a support plate spaced from the heat lamp assembly across from the exposure zone and disposed adjacent to the travel path for guiding a freshly processed substrate as it is transported through the exposure zone; and, a cooling air circulation manifold having a housing panel spaced from the support plate and defining an air circulation passage therebetween, the air circulation manifold having an inlet port for connecting the air circulation passage in flow communication with a source of cooling air, and having a discharge port for extracting cooling air from the air circulation manifold.

* * * * *